US011062714B2

(12) United States Patent
Berthet

(10) Patent No.: US 11,062,714 B2
(45) Date of Patent: *Jul. 13, 2021

(54) AMBISONIC ENCODER FOR A SOUND SOURCE HAVING A PLURALITY OF REFLECTIONS

(71) Applicant: Mimi Hearing Technologies Gmbh, Berlin (DE)

(72) Inventor: Pierre Berthet, Laille (FR)

(73) Assignee: Mimi Hearing Technologies Gmbh, Berlin (DE)

( * ) Notice: Subject to any disclaimer, the term of this patent is extended or adjusted under 35 U.S.C. 154(b) by 23 days.

This patent is subject to a terminal disclaimer.

(21) Appl. No.: 16/657,211

(22) Filed: Oct. 18, 2019

(65) Prior Publication Data

US 2020/0058312 A1 Feb. 20, 2020

Related U.S. Application Data

(63) Continuation of application No. 16/067,975, filed as application No. PCT/EP2016/080216 on Dec. 8, 2016, now Pat. No. 10,475,458.

(30) Foreign Application Priority Data

Jan. 5, 2016 (FR) ..... 1650062

(51) Int. Cl.
*G10L 19/008* (2013.01)
*H04S 3/00* (2006.01)

(52) U.S. Cl.
CPC ..... *G10L 19/008* (2013.01); *H04S 3/008* (2013.01); *H04S 2400/01* (2013.01); *H04S 2400/11* (2013.01); *H04S 2420/11* (2013.01)

(58) Field of Classification Search
CPC ... G10L 19/008; H04S 3/008; H04S 2400/01; H04S 2420/11; H04S 2400/11
(Continued)

(56) References Cited

U.S. PATENT DOCUMENTS 6,021,206 A * 2/2000 McGrath ..... H04S 3/004 381/310
2005/0069143 A1 3/2005 Budnikov et al.
(Continued)

FOREIGN PATENT DOCUMENTS

WO 2017/041922 A1 3/2017

OTHER PUBLICATIONS

Noisternig, et al.; "A 3D Ambisonic Based Binaural Sound Reproduction System"; Jun. 1, 2003; XP055139736, pp. 1-5.
(Continued)

*Primary Examiner* — Paul Kim
(74) *Attorney, Agent, or Firm* — Polsinelli PC

(57) ABSTRACT

The present invention relates to an ambisonic encoder for a sound wave having a plurality of reflections. The ambisonic encoder according to the invention makes it possible to improve the sensation of immersion in a 3D audio scene. The complexity of encoding of the reflections of sound sources for an ambisonic encoder according to the invention is less than the complexity of encoding of the reflections of sound sources of an ambisonic encoder according to the prior art. The ambisonic encoder according to the invention makes it possible to encode a greater number of reflections of a sound source in real time. The ambisonic encoder according to the invention makes it possible to reduce the power consumption related to ambisonic encoding, and to increase the life of a battery of a mobile device used for said application.

12 Claims, 6 Drawing Sheets

(58) Field of Classification Search
USPC ..... 381/23
See application file for complete search history.

(56) References Cited

U.S. PATENT DOCUMENTS

2007/0160216 A1* 7/2007 Nicol ..... G10H 1/0091
381/17
2011/0305344 A1 12/2011 Sole et al.

OTHER PUBLICATIONS

Tsingos, et al.; "Perceptual Audit Rendering of Complex Virtual Environment"; ACM Transactions on Graphics (TOG)—Proceedings of ACM SIGGRAPH 2004, vol. 23, Issue 3, pp. 249-258; Aug. 2004.

* cited by examiner

AMBISONIC ENCODER FOR A SOUND SOURCE HAVING A PLURALITY OF REFLECTIONS

FIELD OF THE INVENTION

The present invention relates to the ambisonic encoding of sound sources. More specifically, it relates to improving the efficiency of this coding, in the case in which a sound source is subject to reflections in a sound scene.

BACKGROUND

Spatial representations of sound combine techniques for capturing, synthesizing and reproducing a sound environment allowing a listener a much greater degree of immersion in a sound environment. They allow in particular a user to discern a number of sound sources that is greater than the number of speakers available to him or her, and to pinpoint these sound sources in 3D, even when the direction thereof is not the same as that of a speaker. There are numerous applications for spatial representations of sound, including allowing a user to pinpoint sound sources in three dimensions on the basis of a sound arising from a set of stereo headphones, or allowing users to pinpoint sound sources in three dimensions in a room, the sound being emitted by speakers, for example 5.1 speakers. Additionally, spatial representations of sound allow new sound effects to be produced. For example, they allow a sound scene to be rotated or the reflection of a sound source to be applied to simulate the reproduction of a given sound environment, for example a cinema hall or a concert hall.

Spatial representations are produced in two main steps: ambisonic encoding and ambisonic decoding. To benefit from a spatial representation of sound, real-time ambisonic decoding is always required. Producing or processing a sound in real time may additionally involve real-time ambisonic encoding thereof. Since ambisonic encoding is a complex task, real-time ambisonic encoding capabilities may be limited. For example, a given amount of computational power will only be capable of encoding a limited number of sound sources in real time.

Techniques for spatially representing sound are described in particular by J. Daniel, *Représentations de champs acoustiques, application à la transmission et à la reproduction de scènes sonores dans un contexte multimédia* (*"Representations of acoustic fields, application to the transmission and to the reproduction of sound scenes in a multimedia context"*), INIST-CNRS, Cote INIST: T 139957. Ambisonically encoding a sound field consists in decomposing the sound pressure field to a point, corresponding for example to the position of a user, in the form of spherical coordinates, expressed in the following form:

$$p(\vec{r}, t) = \sum_{m=0}^{\infty} j^m j_m(kr) \sum_{n=-m}^{+m} B_{mn}(t) Y_{mn}(\theta, \varphi)$$

in which $p(\vec{r}, t)$ represents the sound pressure, at a time t, in the direction $\vec{r}$ with respect to the point at which the sound field is calculated. $j^m$ represents the spherical Bessel function of order m.

$Y_{mn}(\theta,\varphi)$ represents the spherical harmonic of order mn in the directions $(\theta,\varphi)$ defined by the direction $\vec{r}$. The symbol $B_{mn}(t)$ defines the ambisonic coefficients corresponding to the various spherical harmonics, at a time t.

The ambisonic coefficients therefore define, at each time, the entirety of the sound field surrounding a point. The processing of sound fields in the ambisonic domain exhibits particularly interesting properties. In particular, it is very straightforward to rotate the entire sound field. It is also possible to broadcast, over speakers, sound including directional information on the basis of a set of ambisonic coefficients. It is for example possible to broadcast sound over 5.1 speakers. It is also possible to render sound including directional information in a set of headphones having only a left speaker and a right speaker by using transfer functions known as HRTFs (head-related transfer functions). These functions make it possible to render a directional signal over two speakers by adding a delay and/or an attenuation to at least one channel of a stereo signal, this being interpreted by the brain as defining the direction of the sound source.

The decomposition, referred to as HOA (higher order ambisonics), consists in truncating this infinite sum to an order M, greater than or equal to 1:

$$p(\vec{r}, t) = \sum_{m=0}^{M} j^m j_m(kr) \sum_{n=-m}^{+m} B_{mn}(t) Y_{mn}(\theta, \varphi)$$

In general, a source that is sufficiently far away is considered to propagate a sound wave spherically. The value, at a time t, of an ambisonic coefficient $B_{mn}(t)$ linked to this source may then be considered to depend both on the sound pressure S(t) of the source at this time t and on the spherical harmonic linked to the orientation$(\theta_s,\varphi_s)$ of this sound source. It is therefore possible to state, for a single sound source:

$$B_{mn}(t)=S(t)Y_{mn}(\theta_s,\varphi_s)$$

In the case of a set of $N_s$ distant sound sources, the ambisonic coefficients describing the sound scene are calculated as the sum of the ambisonic coefficients of each of the sources, each source i having an orientation $(\theta_{si},\varphi_{si})$:

$$B_{mn}(t) = \sum_{i=0}^{N_s-1} S_i(t) Y_{mn}(\theta_{s_i}, \varphi_{s_i})$$

This calculation may also be represented in vector form:

$$\begin{pmatrix} B_{00}(t) \\ B_{1-1}(t) \\ B_{10}(t) \\ B_{11}(t) \\ \vdots \\ B_{MM}(t) \end{pmatrix} = \sum_{i=0}^{N_s-1} S_i(t) \begin{pmatrix} Y_{00}(\theta_{s_i}, \varphi_{s_i}) \\ Y_{1-1}(\theta_{s_i}, \varphi_{s_i}) \\ Y_{10}(\theta_{s_i}, \varphi_{s_i}) \\ Y_{11}(\theta_{s_i}, \varphi_{s_i}) \\ \vdots \\ Y_{MM}(\theta_{s_i}, \varphi_{s_i}) \end{pmatrix}$$

The ambisonic coefficients retain the form $B_{mn}$, where, to the order M, m ranging from 0 to M, and n ranging from −m to m.

A device comprising ambisonic encoding of at least one source may therefore define a complete sound field by calculating the ambisonic coefficients to an order M. Depending on the order M, and on the number of sources, this calculation may be long and resource intensive. Specifically, to an order M, $(M+1)^2$ ambisonic coefficients are calculated at each time t. For each coefficient, the contribution $B_{mn}(t)=S(t)Y_{mn}(\theta_s,\varphi_s)$ of each of the $N_s$ sources must be calculated. If a source S is fixed, the spherical harmonic $Y_{mn}(\theta_s,\varphi_s)$ may be pre-calculated. Otherwise, it must be recalculated at each time.

Increasing the order of the ambisonic coefficient allows better quality auditory rendition. It may therefore be difficult to obtain good sound quality while keeping the computing time and load, the electrical consumption and the battery usage at reasonable levels. This is even more the case now that ambisonic coefficients are often calculated in real time on mobile devices. Consider for example the case of a smartphone for listening to music in real time, with directional information calculated using ambisonic coefficients.

This issue becomes more problematic when reflections are calculated in a sound scene.

Calculating reflections make it possible to simulate a sound scene in a room, for example a cinema or concert hall. Under these conditions, the sound is reflected off the walls of the hall, giving a characteristic "ambience", the reflections being defined by the respective positions of the sound sources and of the listener, as well as by the materials over which the sound waves are diffused, for example the material of the walls. Creating hall-like sound effects using ambisonic audio coding is described in particular by J. Daniel, *Représentations de champs acoustiques, application à la transmission et à la reproduction de scènes sonores dans un contexte multimédia* (*"Representations of acoustic fields, application to the transmission and to the reproduction of sound scenes in a multimedia context"*), INIST-CNRS, Cote INIST: T 139957, pp. 283-287.

It is possible to simulate the effect of reflections and to give an "ambience" in ambisonics by adding, for each sound source, a set of secondary sound sources, the intensity and the direction of which are calculated on the basis of the reflections of the sound sources off the walls and obstacles of a sound scene. Several sound sources are required for each initial sound source to simulate a sound scene in a satisfactory manner. However, this makes the aforementioned problem of computational power and battery capacity even worse, since the complexity of calculating the ambisonic coefficients is further multiplied by the number of secondary sound sources. The complexity of calculating the ambisonic coefficients for a satisfactory sound rendition may then make this solution impracticable, for example because it becomes impossible to calculate the ambisonic coefficients in real time, because the computing load for calculating the ambisonic coefficients becomes too great, or because the electrical and/or battery consumption on a mobile device becomes prohibitive.

N. Tsingos et al. *Perceptual Audio Rendering of Complex Virtual Environment*, ACM Transactions on Graphics (TOG)—Proceedings of ACM SIGGRAPH 2004, Volume 23 Issue 3, August 200, pp. 249-258 discloses a binaural processing method for overcoming this problem. The solution proposed by Tsingos consists in decreasing the number of sound sources by:

- evaluating the power of each sound source;
- classing the sound sources, from the most to the least powerful;
- removing the least powerful sound sources;
- grouping the remaining sound sources together into clusters of sound sources that are close to one another, and merging them to obtain, for each cluster, a single virtual sound source.

The method disclosed by Tsingos makes it possible to decrease the number of sound sources, and hence the complexity of overall processing when reverberations are used. However, this technique has several drawbacks. It does not improve the complexity of processing the reverberations themselves. The same problem would be encountered again if, with a smaller number of sources, it is desired to increase the number of reverberations. Additionally, the processing operations for determining the sound power of each source and for merging the sources into clusters have a substantial computing load themselves. The described experiments are limited to cases in which the sound sources are known in advance, and their respective powers have been pre-calculated. In the case of sound scenes for which multiple sources of various intensities are present, and the powers of which have to be recalculated, the associated computing load would, at least partially, cancel out the computing gain obtained by limiting the number of sources.

Lastly, the tests conducted by Tsingos provide satisfactory results when the sound sources are akin to noise, for example in the case of a crowd in the subway. For other types of sound sources, such a method could prove to be deleterious. For example, when recording a concert given by a symphony orchestra, it is often the case that several instruments, although exhibiting a low level of sound power, make an important contribution to the overall harmony. Simply removing the associated sound sources, just because they are relatively weak, would then have a severely negative effect on the quality of the recording.

There is therefore a need for a device and for a method for calculating ambisonic coefficients, which makes it possible to calculate, in real time, a set of ambisonic coefficients representing at least one sound source and one or more reflections thereof in a sound scene, while limiting the additional computational complexity linked to the one or more reflections of the sound source, without a priori decreasing the number of sound sources.

SUMMARY OF THE INVENTION

To this end, the invention relates to an ambisonic encoder for a sound wave having a plurality of reflections, comprising: a logic for transforming the frequency of the sound wave; a logic for calculating spherical harmonics of the sound wave and of the plurality of reflections on the basis of a position of a source of the sound wave and positions of obstacles to propagation of the sound wave; a plurality of filtering logics in the frequency domain receiving, as input, spherical harmonics of the plurality of reflections, each filtering logic being parameterized by acoustic coefficients and delays of the reflections; a logic for adding spherical harmonics of the sound wave and outputs from the filtering logics.

Advantageously, the logic for calculating spherical harmonics of the sound wave is configured to calculate the spherical harmonics of the sound wave and of the plurality of reflections on the basis of a fixed position of the source of the sound wave.

Advantageously, the logic for calculating spherical harmonics of the sound wave is configured to iteratively calculate the spherical harmonics of the sound wave and of the plurality of reflections on the basis of successive positions of the source of the sound wave.

Advantageously, each reflection is characterized by a unique acoustic coefficient.

Advantageously, each reflection is characterized by an acoustic coefficient for each frequency of said frequency sampling.

Advantageously, the reflections are represented by virtual sound sources.

Advantageously, the ambisonic encoder further comprises logic for calculating the acoustic coefficients, the delays and the position of the virtual sound sources of the reflections, said calculating logic being configured to calculate the acoustic coefficients and the delays of the reflections according to estimates of a difference in the distance traveled by the sound between the position of the source of the sound wave and an estimated position both of a user and of a distance traveled by the sound between the positions of the virtual sound sources of the reflections and the estimated position of the user.

Advantageously, the logic for calculating the acoustic coefficients, the delays and the positions of the virtual sound sources of the reflections is further configured to calculate the acoustic coefficients of the reflections according to at least one acoustic coefficient of at least one obstacle to the propagation of sound waves, off which the sound is reflected.

Advantageously, the logic for calculating the acoustic coefficients, the delays and the positions of the virtual sound sources of the reflections is further configured to calculate the acoustic coefficients of the reflections according to an acoustic coefficient of at least one obstacle to the propagation of sound waves, off which the sound is reflected.

Advantageously, the logic for calculating spherical harmonics of the sound wave and of the plurality of reflections is further configured to calculate spherical harmonics of the sound wave and of the plurality of reflections at each output frequency of the frequency transformation circuit, said ambisonic encoder further comprising logic for calculating binaural coefficients of the sound wave, which logic is configured to calculate binaural coefficients of the sound wave by multiplying, at each output frequency of the circuit for transforming the frequency of the sound wave, the signal of the sound wave by the spherical harmonics of the sound wave and of the plurality of reflections at this frequency.

Advantageously, the logic for calculating the acoustic coefficients, the delays and the positions of the virtual sound sources of the reflections is configured to calculate acoustic coefficients and delays of a plurality of late reflections.

The invention also relates to a method for ambisonically encoding a sound wave having a plurality of reflections, comprising: transforming the frequency of the sound wave; calculating spherical harmonics of the sound wave and of the plurality of reflections on the basis of a position of a source of the sound wave and positions of obstacles to propagation of sound waves; filtering, by a plurality of logics for filtering in the frequency domain, spherical harmonics of the plurality of reflections, each filtering logic being parameterized by acoustic coefficients and delays of the reflections; adding spherical harmonics of the sound wave and outputs from the filtering logic.

The invention also relates to a computer program for ambisonically encoding a sound wave having a plurality of reflections, comprising: computer code instructions configured to transform the frequency of the sound wave; computer code instructions configured to calculate spherical harmonics of the sound wave and of the plurality of reflections on the basis of a position of a source of the sound wave and positions of obstacles to propagation of the sound wave; computer code instructions configured to parameterize a plurality of logics for filtering in the frequency domain receiving, as input, spherical harmonics of the plurality of reflections, each filtering logic being parameterized by acoustic coefficients and delays of the reflections; computer code instructions configured to add spherical harmonics of the sound wave and outputs from the filtering logics.

The ambisonic encoder according to the invention makes it possible to improve the sensation of immersion in a 3D audio scene.

The complexity of encoding of the reflections of sound sources for an ambisonic encoder according to the invention is less than the complexity of encoding of the reflections of sound sources of an ambisonic encoder according to the prior art.

The ambisonic encoder according to the invention makes it possible to encode a greater number of reflections of a sound source in real time.

The ambisonic encoder according to the invention makes it possible to reduce the power consumption related to ambisonic encoding, and to increase the life of a battery of a mobile device used for said application.

BRIEF DESCRIPTION OF THE DRAWING

Other features will become apparent on reading the following nonlimiting detailed description given by way of example in conjunction with appended drawings, which show.

DETAILED DESCRIPTION

Figure 1A:
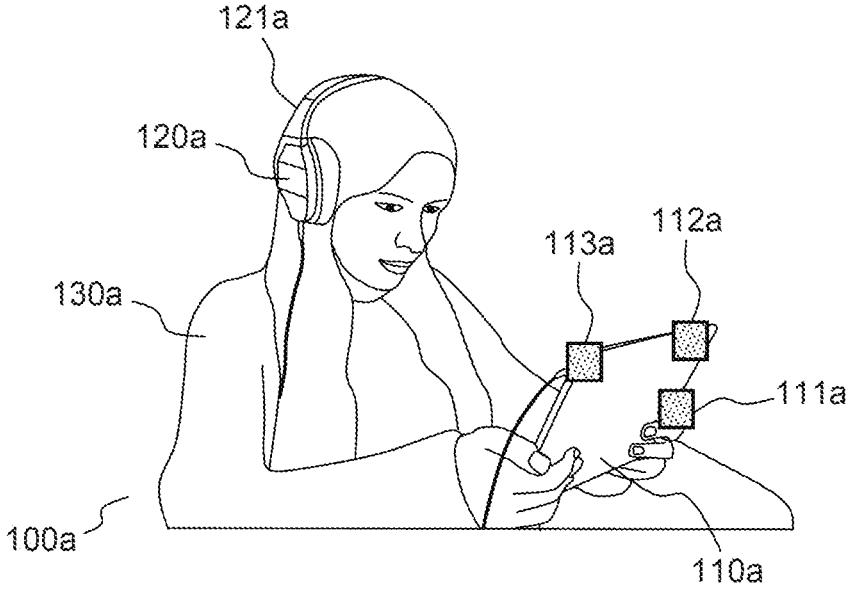
FIGS. 1*a* and 1*b*, two examples of systems for listening to sound waves, according to two embodiments of the invention.
Figure 1B:
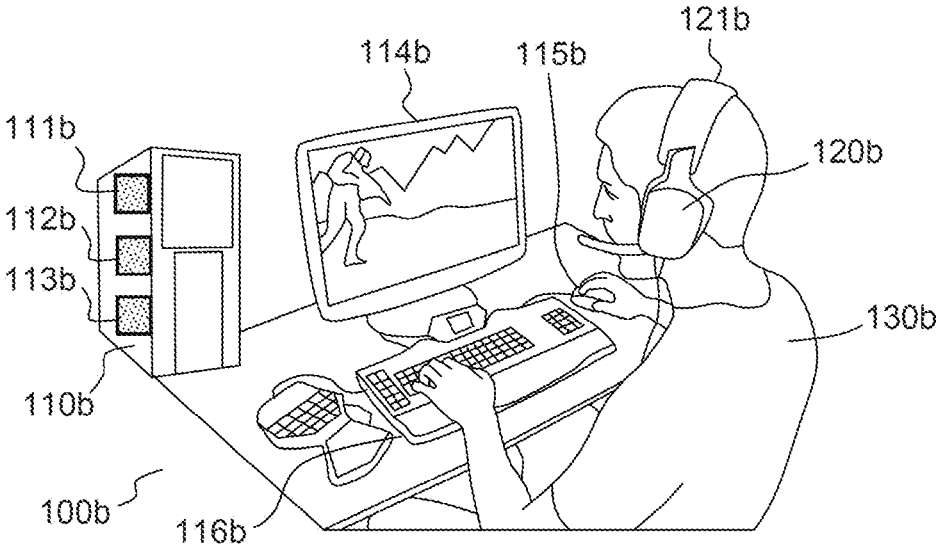

FIGS. 1*a* and 1*b* show two examples of systems for listening to sound waves, according to two embodiments of the invention.

FIG. 1*a* shows one example of a system for listening to sound waves, according to one embodiment of the invention.

The system 100*a* comprises a touchscreen tablet 110*a* and a set of headphones 120*a* to allow a user 130*a* to listen to a sound wave. The system 100*a* comprises, solely by way of example, a touchscreen tablet. However, this example is also applicable to a smartphone, or to any other mobile device having display and sound broadcast capabilities. The sound wave may for example arise from the playback of a film or a game. According to several embodiments of the invention, the system 100*a* may be configured to listen to multiple sound waves. For example, when the system 100*a* is configured for the playback of a film comprising a 5.1 multichannel soundtrack, six sound waves are heard simultaneously. Similarly, when the system 100*a* is configured for playing a game, numerous sound waves may be heard simultaneously. For example, in the case of a game involving multiple characters, a sound wave may be created for each character.

Each of the sound waves is associated with a sound source, the position of which is known.

The touchscreen tablet 110*a* comprises an ambisonic encoder 111*a* according to the invention, a transformation circuit 112*a*, and an ambisonic decoder 113*a*.

According to one set of embodiments of the invention, the ambisonic encoder 111*a*, the transformation circuit 112*a* and the ambisonic decoder 113*a* consist of computer code instructions run on a processor of the touchscreen tablet. They may for example have been obtained by installing an application or specific software on the tablet. In other embodiments of the invention, at least one from among the ambisonic encoder 111*a*, the transformation circuit 112*a* and the ambisonic decoder 113*a* is a specialized integrated circuit, for example an ASIC (application-specific integrated circuit) or an FPGA (field-programmable gate array).

The ambisonic encoder 111*a* is configured to calculate, in the frequency domain, a set of ambisonic coefficients representing the entirety of a sound scene on the basis of at least one sound wave. It is additionally configured to apply reflections to at least one sound wave so as to simulate a listening environment, for example a cinema hall of a certain size, or a concert hall.

The transformation circuit 112*a* is configured to rotate the sound scene by modifying the ambisonic coefficients so as to simulate the rotation of the head of the user so that, regardless of the orientation of his or her face, the various sound waves appear to reach him or her from one and the same position. For example, if the user turns his or her head to the left by an angle $\alpha$, rotating the sound scene to the right by one and the same angle $\alpha$ allows the sound to continue to reach him or her from the same direction. According to one set of embodiments of the invention, the set of headphones 120*a* is provided with at least one motion sensor 121*a*, for example a gyrometer, making it possible to obtain an angle, or a derivative of an angle, of rotation of the head of the user 130*a*. A signal representing an angle of rotation, or of a derivative of an angle of rotation, is then sent by the set of headphones 121*a* to the tablet 120*a* so that the transformation circuit 112*a* rotates the corresponding sound scene.

The ambisonic decoder 113*a* is configured to render the sound scene over the two stereo channels of the set of headphones 120*a* by converting the transformed ambisonic coefficients into two stereo signals, one for the left channel and the other for the right channel. In one set of embodiments of the invention, the ambisonic decoding is performed using functions referred to as HRTFs (head-related transfer functions) making it possible to render, over two stereo channels, the directions of the various sound sources. French patent application no 1558279, filed by the applicant, describes a method for creating HRTFs that are optimized for a user according to a pool of HRTFs and features of the face of said user.

The system 100*a* thus allows the user thereof to benefit from a particularly immersive experience: during a game or the playback of an item of multimedia content, in addition to the image, this system allows him or her to benefit from an impression of being immersed in a sound scene. This impression is amplified both by tracking the orientations of the various sound sources when the user turns his or her head, and by applying reflections giving an impression of immersion in a particular sound environment. This system makes it possible, for example, to watch a film or a concert with a set of audio headphones while having an impression of being immersed in a cinema hall or a concert hall. All of these operations are performed in real time, thereby making it possible to continually adapt the sound perceived by the user to the orientation of his or her head.

The ambisonic encoder 111*a* according to the invention makes it possible to encode a greater number of reflections of the sound sources with a lower degree of complexity with respect to an ambisonic encoder of the prior art. It therefore makes it possible to perform all of the ambisonic calculations in real time while increasing the number of reflections of the sound sources. This increase in the number of reflections allows the simulated listening environment (concert hall, cinema hall, etc.) to be modeled more finely and hence the sensation of being immersed in the sound scene to be enhanced. Decreasing the complexity of the ambisonic encoding also allows, assuming an equal number of sound sources, the electrical consumption of the encoder to be decreased with respect to an encoder of the prior art, and hence the duration of discharge of the battery of the touchscreen tablet 110*a* to be improved. This therefore makes it possible for the user to enjoy an item of multimedia content for a longer time.

FIG. 1*b* shows a second example of a system for listening to sound waves, according to one embodiment of the invention.

The system 100*b* comprises a central unit 110*b* connected to a monitor 114*b*, a mouse 115*b* and a keyboard 116*b*, and a set of headphones 120*b*, and is used by a user 130*b*. The central unit comprises an ambisonic encoder 111*b* according to the invention, a transformation circuit 112*b*, and an ambisonic decoder 113*b*, which are respectively akin to the ambisonic encoder 111*a*, transformation circuit 112*a*, and ambisonic decoder 113*a* of the system 100*a*. Similarly to the system 100*a*, the ambisonic encoder 111*a* is configured to encode at least one wave representing a sound scene by adding reflections thereto, the set of headphones 120*a* comprises at least one motion sensor 120*b*, the transmission circuit 120*b* is configured to rotate the sound scene so as to track the orientation of the head of the user, and the ambisonic decoder 113*b* is configured to render the sound over the two stereo channels of the set of headphones 120*b* so that the user 130*b* has an impression of being immersed in a sound scene.

The system 100*b* is suitable both for viewing multimedia content and for video gaming. Specifically, in a video game, there may be a very large number of sound waves arising from various sources. This is the case, for example, in a strategy or combat game, in which numerous characters may issue different sounds (sounds for steps, running, shooting, etc.) for various sound sources. An ambisonic encoder 111*b* makes it possible to encode all of these sources while adding numerous reflections thereto, making the scene more realistic and immersive, in real time. Thus, the system 100*b* comprising an ambisonic encoder 111*b* according to the invention allows an immersive experience in a video game, with a large number of sound sources and reflections.

Figure 2:
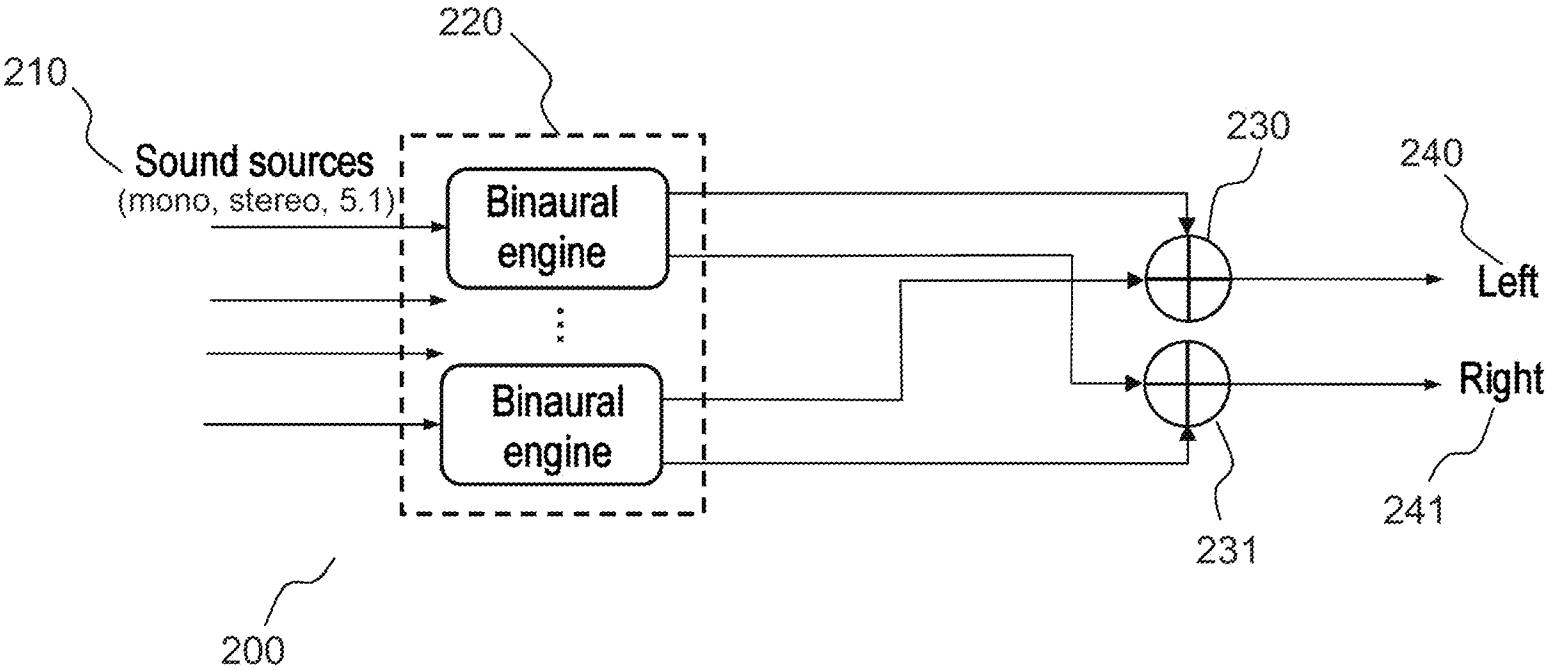
PRIOR ART FIG.2
FIG. 2, one example of a binauralizing system comprising an engine for binauralizing an audio scene per sound source according to the prior art.

FIG. 2 shows one example of a binauralizing system comprising an engine for binauralizing an audio scene per sound source according to the prior art.

The binauralizing system 200 is configured to transform a set 210 of sound sources of a sound scene into a left channel 240 and a right channel 241 of a stereo listening system, and comprises a set of binaural engines 220, comprising one binaural engine per sound source.

The sources may be any type of sound sources (mono, stereo, 5.1, multiple sound sources in the case of a video game for example). Each sound source is associated with an orientation in space, for example defined by angles (θ, φ) in a frame of reference, and by a sound wave, which is itself represented by a set of time samples.

Each of the binauralizing engines of the set 220 is configured, for a sound source and at each time t corresponding to a sample of the sound source:

- to perform HOA encoding of the sound source to an order M;
- to perform a transformation on the binaural coefficients, for example a rotation;
- to calculate a sound intensity $p(\vec{r}, t)$ at times t for a set of output channels, in which $\vec{r}$ represents the orientation of the output channel.

The possible output channels correspond to the various listening channels. It is possible for example to have two output channels in a stereo listening system, six output channels in a 5.1 listening system, etc.

Each binauralizing engine produces two outputs (a left output and a right output) and the system 200 comprises an adder circuit 230 for adding all of the left outputs and an adder circuit 231 for adding all of the right outputs of the set 220 of binauralizing engines. The outputs of the adder logics 230 and 231 are respectively the sound wave of the left channel 240 and the sound wave of the right channel 241 of a stereo listening system.

The system 200 makes it possible to transform all of the sound sources 210 into two stereo channels while being able to apply all of the transformations allowed by ambisonics, such as rotations.

However, the system 200 has one major drawback in terms of computing time: it requires calculations to calculate the ambisonic coefficients of each sound source, calculations for the transformations of each sound source, and calculations for the outputs associated with each sound source. The computing load for a sound source to be processed by the system 200 is therefore proportional to the number of sound sources and may, for a large number of sound sources, become prohibitive.

Figure 3A:
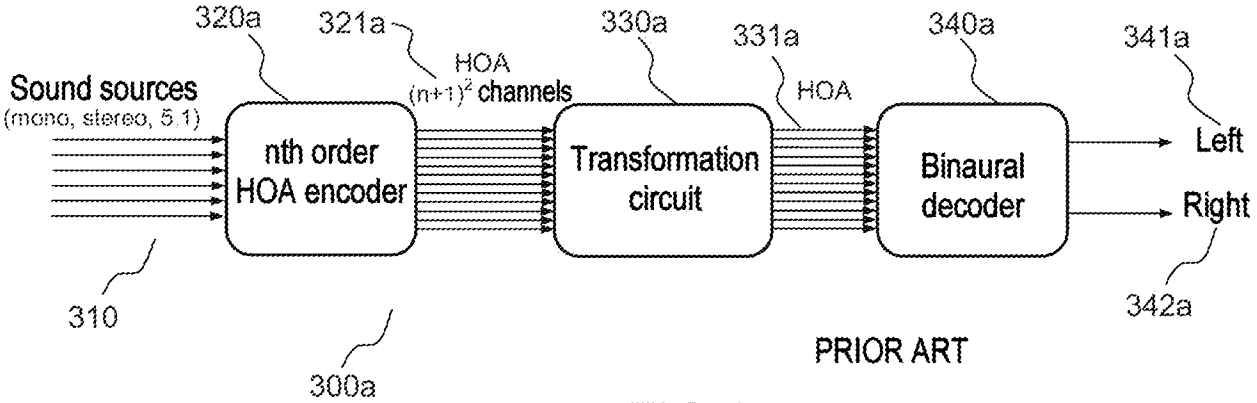
PRIOR ART FIG.3a
FIGS. 3*a* and 3*b*, two examples of engines for binauralizing a 3D scene in the time domain and in the frequency domain, respectively, according to the prior art.
Figure 3B:
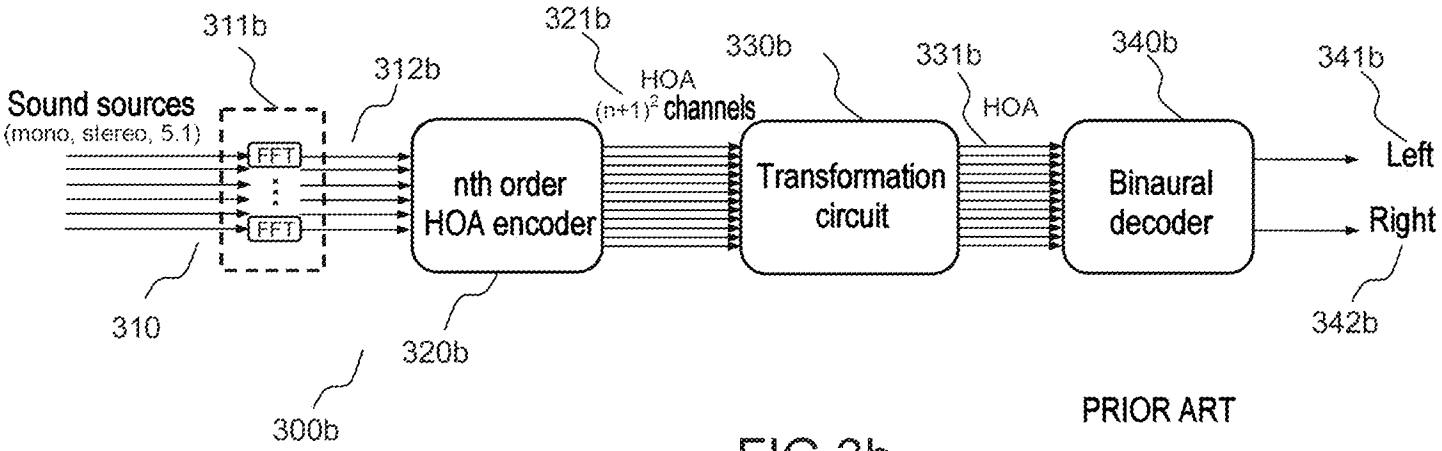
PRIOR ART FIG.3b

FIGS. 3*a* and 3*b* show two examples of engines for binauralizing a 3D scene in the time domain and in the frequency domain, respectively, according to the prior art.

FIG. 3*a* shows one example of an engine for binauralizing a 3D scene in the time domain according to the prior art.

To limit the complexity of binaural processing in the case of a large number of sources, the binauralizing engine 300*a* comprises a single HOA encoding engine 320*a* for all of the sources 310 of the sound scene. This encoding engine 320*a* is configured to calculate, at each time interval, the binaural coefficients of each sound source according to the intensity and the position of the sound source at said time interval, then to sum the binaural coefficients of the various sound sources. This makes it possible to obtain a single set 321*a* of binaural coefficients that are representative of the entirety of the sound scene.

The binauralizing engine 320*a* next comprises a circuit 330*a* for transforming the coefficients, which circuit is configured to transform the set of coefficients 321*a* that are representative of the sound scene into a set of transformed coefficients 331*a* that are representative of the entirety of the sound scene. This makes it possible for example to rotate the entire sound scene.

The binauralizing engine 300*a* next comprises a binaural decoder 340*a* configured to render the transformed coefficients 331*a* as a set of output channels, for example a left channel 341*a* and a right channel 342*a* of a stereo system.

The binauralizing engine 300*a* therefore makes it possible to decrease the computational complexity required for the binaural processing of a sound scene with respect to the system 200 by applying the transformation and decoding steps to the entirety of the sound scene, rather than to each sound source individually.

FIG. 3*b* shows one example of an engine for binauralizing a 3D scene in the frequency domain according to the prior art.

The binauralizing engine 300*b* is quite similar to the binauralizing engine 300*a*. It comprises a set 311*b* of frequency transformation logic, the set 311*b* comprising one frequency transformation logic for each sound source. The frequency transformation logics may for example be configured to apply a fast Fourier transform (FFT) to obtain a set 312*b* of sources in the frequency domain. The application of frequency transforms is well known to those skilled in the art, and is for example described by A. Mertins, *Signal Analysis: Wavelets, Filter banks, Time-Frequency Transforms and Applications, English* (revised edition). ISBN: 9780470841839. It consists for example in transforming, via time windows, the sound samples into frequency intensities, according to frequency sampling. The inverse operation, or inverse frequency transform (referred to as $FFT^{-1}$, or inverse fast Fourier transform, in the case of a fast Fourier transform) makes it possible to retrieve, on the basis of frequency sampling, intensities of sound samples.

The binauralizing engine 300*b* next comprises an HOA encoder 320*b* in the frequency domain. The encoder 320*b* is configured to calculate, for each source and at each frequency of frequency sampling, the corresponding ambisonic coefficients, then to add the ambisonic coefficients of the various sources to obtain a set 321*b* of ambisonic samples that are representative of the entirety of the sound scene, at various frequencies. An ambisonic coefficient at a sampling frequency f is obtained in a similar manner to an ambisonic coefficient at time t by the formula: $B_{mn}(f)=S(f)Y_{mn}(\theta_s,\varphi_s)$.

The binauralizing engine 300*b* next comprises a transformation circuit 330*b*, similar to the transformation circuit 330*a*, making it possible to obtain a set of 331 b of transformed ambisonic coefficients that are representative of the entirety of the sound scene, and a binaural decoder 340*b* configured to render two stereo channels 341*b* and 342*b*. The binaural decoder 340*b* comprises an inverse frequency transformation circuit so as to render the stereo channels in the time domain.

The properties of the binauralizing engine 300*b* are quite similar to those of the binauralizing engine 300*a*. It also makes it possible to binaurally process a sound scene with a lower level of complexity with respect to the system 200.

In the case of a substantial increase in the number of sources, the complexity of the binaural processing of the binaural engines 300*a* and 300*b* is mainly due to the HOA coefficients being calculated by the encoders 320*a* and 320*b*. Specifically, the number of coefficients to be calculated is proportional to the number of sources. Conversely, the transformation circuits 330*a* and 330*b*, along with the binaural decoders 340*a* and 340*b*, process sets of binaural coefficients that are representative of the entirety of the sound scene, the number of which does not vary with the number of sources.

To process the reflections, the complexity of the binaural encoders 320*a* and 320*b* may increase substantially. Specifically, the solution of the prior art to process reflections consists in adding a virtual sound source for each reflection.

The complexity of the HOA encoding of these encoders according to the prior art therefore increases in proportion to the number of reflections per source, and may become problematic when the number of reflections becomes too important.

Figure 4:
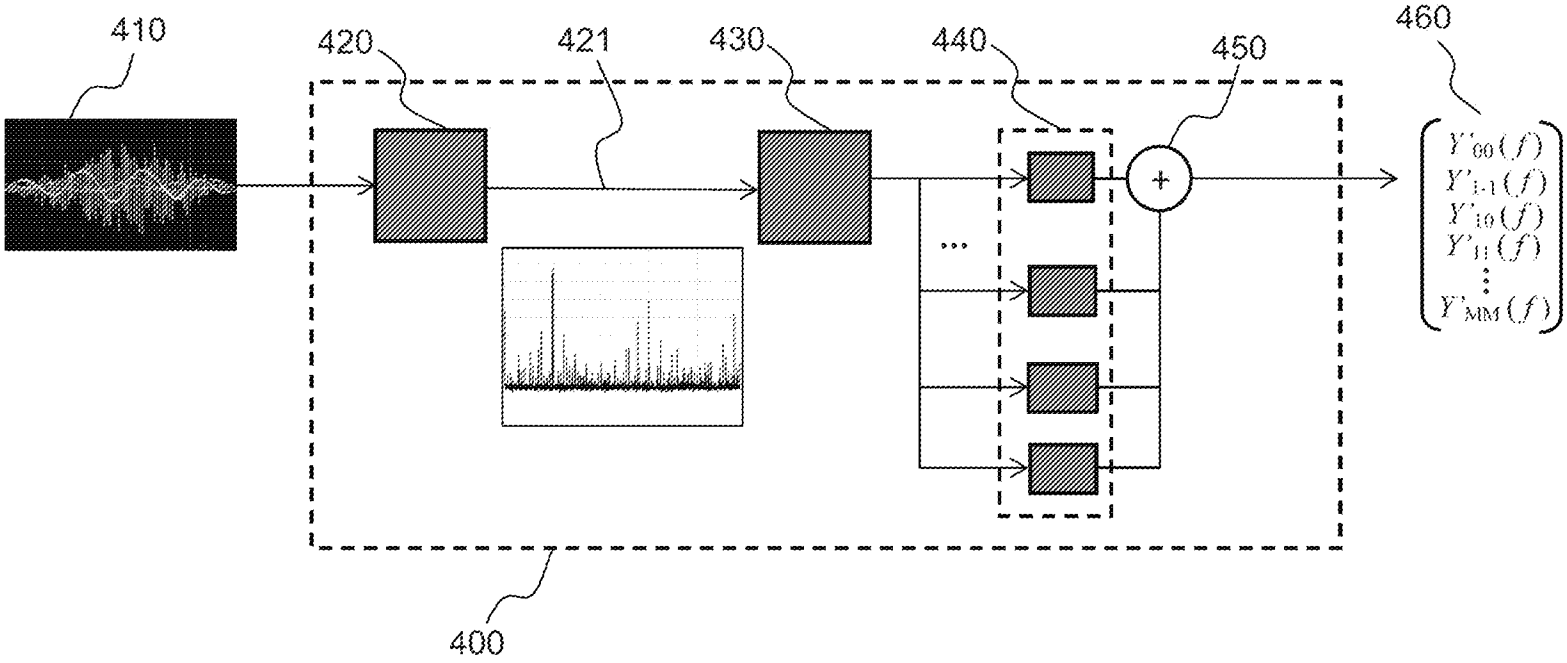
FIG. 4, one example of an ambisonic encoder for ambisonically encoding a sound wave having a plurality of reflections, in one set of modes of implementation of the invention.

FIG. 4 shows one example of an ambisonic encoder for ambisonically encoding a sound wave having a plurality of reflections, in one set of modes of implementation of the invention.

The ambisonic encoder 400 is configured to encode a sound wave 410 with a plurality of reflections as a set of ambisonic coefficients to an order M. To do this, the ambisonic encoder is configured to calculate a set 460 of spherical harmonics that are representative of the sound wave and of the plurality of reflections. The ambisonic encoder 400 will be described, by way of example, for the encoding of a single sound wave. However, an ambisonic encoder 400 according to the invention may also encode a plurality of sound waves, the elements of the ambisonic encoder being used in the same way for each additional sound wave. The sound wave 410 may correspond for example to a channel of an audio track, or to a sound wave created dynamically, for example a sound wave corresponding to an object of a video game. In one set of embodiments of the invention, the sound waves are defined by successive samples of sound intensity. According to various embodiments of the invention, the sound waves may for example be sampled at a frequency of 22500 Hz, 12000 Hz, 44100 Hz, 48000 Hz, 88200 Hz or 96000 Hz, and each of the intensity samples coded on 8, 12, 16, 24 or 32 bits. In the case of a plurality of sound waves, these may be sampled at different frequencies, and the samples may be coded on different numbers of bits.

The ambisonic encoder 400 comprises a logic 420 for transforming the frequency of the sound wave. This is similar to the logics 311*b* for transforming the frequency of the sound waves of the binauralizing system 300*b* according to the prior art. In embodiments having a plurality of sound waves, the encoder 400 comprises frequency transformation logic for each sound wave. At the output of the frequency transformation logic, a sound wave is defined 421, for a time window, by a set of intensities at various frequencies of frequency sampling. In one set of embodiments of the invention, the frequency transformation logic 420 is a logic applying an FFT.

The encoder 400*a* also comprises a logic 430 for calculating spherical harmonics of the sound wave and of the plurality of reflections on the basis of a position of a source of the sound wave and positions of obstacles to the propagation of the sound wave. In one set of embodiments of the invention, the position of the source of the sound wave is defined by angles $(\theta_{s_i},\varphi_{s_i})$ and a distance with respect to a listening position of the user. The spherical harmonics $Y_{00}(\theta_{s_i},\varphi_{s_i})$, $Y_{1-1}(\theta_{s_i},\varphi_{s_i})$, $Y_{10}(\theta_{s_i},\varphi_{s_i})$, $Y_{11}(\theta_{s_i},\varphi_{s_i})$, . . . , $Y_{MM}(\theta_{s_i},\varphi_{s_i})$, of the sound wave to the order M may be calculated according to methods known from the prior art, on the basis of angles $(\theta_{s_i},\varphi_{s_i})$ defining the orientation of the source source of the sound wave.

The logic 430 is also configured to calculate, on the basis of the position of the source of the sound wave, a set of spherical harmonics of the plurality of reflections. In a set of embodiments of the invention, the logic 430 is configured to calculate, on the basis of the position of the source of the sound wave, and positions of obstacles to the propagation of the sound wave, an orientation of a virtual source of a reflection, defined by angles $(\theta_{s,r},\varphi_{s,r})$, then, on the basis of these angles, spherical harmonics $Y_{00}(\theta_{s,r},\varphi_{s,r})$, $Y_{1-1}(\theta_{s,r},\varphi_{s,r})$, $Y_{10}(\theta_{s,r},\varphi_{s,r})$, $Y_{11}(\theta_{s,r},\varphi_{s,r})$, . . . , $Y_{MM}(\theta_{s,r},\varphi_{s,r})$ of the reflection of the sound wave. This makes it possible to obtain, for each reflection, the spherical harmonics corresponding to the direction of the wave reflected off the obstacles to the propagation of the sound wave.

The ambisonic encoder 400 also comprises a plurality 440 of logics for filtering in the frequency domain receiving, as input, spherical harmonics of the plurality of reflections, each filtering logic being parameterized by acoustic coefficients and delays of the reflections. Throughout the rest of the description, $\alpha_r$ will denote an acoustic coefficient of a reflection and $\delta_r$ will denote a delay of a reflection. According to various embodiments of the invention, the acoustic coefficient may be a reverberation coefficient $\alpha_r$, representing a ratio of the intensities of a reflection to the intensities of the sound source and defined between 0 and 1. According to other embodiments of the invention, the acoustic coefficient is a coefficient $\alpha_a$ referred to as an attenuation or an absorption coefficient, which coefficient is defined between 0 and 1 such that $\alpha_a=\alpha_r-1$. These filtering logics make it possible to apply a delay and an attenuation to the ambisonic coefficients of a reflection. Thus, the combination of the orientation of the virtual source of the reflection, of the delay and of the attenuation of the reflection makes it possible to model each reflection as a replica of the sound source coming from a different direction, assigned a delay and attenuated, subsequent to the travel and to the reflections of the sound source. This model makes it possible, with multiple reflections, to simulate the propagation of a sound wave in a scene in a straightforward and effective manner.

In general, the filtering, at a frequency f, of a spherical harmonic of a reflection may be written as: $H_r(f)\ Y_{ij}(\theta_{s,r},\varphi_{s,r})$. In one embodiment of the invention, a filtering logic 440 is configured to filter the spherical harmonics by applying: $\alpha_r e^{-j2\pi f\delta_r} Y_{ij}(\theta_{s,r},\varphi_{s,r})$. In this embodiment, the coefficient $\alpha_r$ is treated as a reverberation coefficient. In other embodiments, a coefficient $\alpha_a$ may be treated as an attenuation coefficient, and the spherical harmonics may for example be filtered by applying: $(1-\alpha_a)e^{-j2\pi f\delta_r} Y_{ij}(\theta_{s,r},\varphi_{s,r})$. Throughout the rest of the description, unless stated otherwise, the coefficient $\alpha_r$ will be considered to be a reverberation coefficient. A person skilled in the art will however easily be capable of implementing the various embodiments of the invention with an attenuation coefficient instead of a reverberation coefficient.

The ambisonic encoder 400 also comprises a logic 450 for adding the spherical harmonics of the sound wave and outputs from the filtering logics. This logic makes it possible to obtain a set $Y'_{00}$, $Y'_{1-1}$, $Y'_{10}$, $Y'_{11}$, . . . $Y'_{MM}$ of spherical harmonics to the order M, which are representative both of the sound wave and of the reflections of the sound wave in the frequency domain. A spherical harmonic $Y'_{ij}$ (where $0\le i\le M$, and $-i\le j\le i$) representing both the sound wave and the reflections of the sound wave is therefore equal, as output by the adder logic 450, to the value $Y_{ij}=Y_{ij}(\theta_{s_i},\varphi_{s_i})+\Sigma_{r=0}^{N_r} H_r(f)Y_{ij}(\theta_{s,r},\varphi_{s,r})$, in which $Y_{ij}(\theta_{s_i},\varphi_{s_i})$ is a spherical harmonic of the source of the sound wave, $N_r$ is the number of reflections of the sound wave, $Y_{ij}(\theta_{s,r},\varphi_{s,r})$ are the spherical harmonics of the positions of the virtual sound sources of the reflections, and the terms $H_r(f)$ are the logics for filtering the spherical harmonics for the reflection r at a frequency f. In one set of embodiments of the invention, the filtering logics $H_r(f)$ are such that $H_r(f)=\alpha_r e^{-j2\pi f\delta_r}$, and the spherical harmonics $Y_{ij}$ to the order M, representing both the sound wave and the reflections of the sound wave, are equal, as output by the adder logic 450, to: $Y'_{ij}=Y_{ij}(\theta_{s_i},\varphi_{s_i})+\Sigma_{r=0}^{N_r}\alpha_r e^{-j2\pi f\delta_r} Y_{ij}(\theta_{s,r},\varphi_{s,r})$.

According to various embodiments of the invention, the number $N_r$ of reflections may be predefined. According to other embodiments of the invention, the reflections of the sound wave are retained according to their acoustic coefficient, the number Nr of reflections then depending on the position of the sound wave, on the position of the user, and on the obstacles to the propagation of the sound. In the above example, the acoustic coefficient is defined as a ratio of the intensity of the reflection to the intensity of the sound source, i.e. a reverberation coefficient. In one embodiment of the invention, the reflections of the sound wave having an acoustic coefficient that is above or equal to a predefined threshold are retained. In other embodiments, the acoustic coefficient is defined as an attenuation coefficient, i.e. a ratio of the sound intensity absorbed by the obstacles to the propagation of sound waves and the path through the air to the intensity of the sound source. In this embodiment, the reflections of the sound wave having an acoustic coefficient that is below or equal to a predefined threshold are retained.

Thus, the ambisonic encoder 400 makes it possible to calculate a set of spherical harmonics $Y'_{ij}$ representing both the sound wave and its reflections. Once these spherical harmonics have been calculated, the encoder may comprise a logic for multiplying the spherical harmonics by the sound intensity values of the source at the various frequencies so as to obtain ambisonic coefficients that are representative both of the sound wave and of the reflections. In embodiments having multiple sound sources, the encoder 400 comprises a logic for adding the ambisonic coefficients of the various sound sources and of their reflections, making it possible to obtain, as output, ambisonic coefficients that are representative of the entirety of the sound scene.

In one set of embodiments of the invention, the ambisonic coefficients to the order M representing the sound scene are then equal, as output by the logic for adding the ambisonic coefficients of the various sound sources and of their reflections, for Ns sound sources and for a frequency f, to:

$$\begin{pmatrix} B_{00}(f) \\ B_{1-1}(f) \\ B_{10}(f) \\ B_{11}(f) \\ \vdots \\ B_{MM}(f) \end{pmatrix} = \sum_{i=0}^{N_s-1} S_i(f) \begin{pmatrix} Y_{00}(\theta_{s_i}, \varphi_{s_i}) + \sum_{r=0}^{N_r} H_r(f) Y_{00}(\theta_{s,r}, \varphi_{s,r}) \\ Y_{1-1}(\theta_{s_i}, \varphi_{s_i}) + \sum_{r=0}^{N_r} H_r(f) Y_{1-1}(\theta_{s,r}, \varphi_{s,r}) \\ Y_{10}(\theta_{s_i}, \varphi_{s_i}) + \sum_{r=0}^{N_r} H_r(f) Y_{10}(\theta_{s,r}, \varphi_{s,r}) \\ Y_{11}(\theta_{s_i}, \varphi_{s_i}) + \sum_{r=0}^{N_r} H_r(f) Y_{11}(\theta_{s,r}, \varphi_{s,r}) \\ \vdots \\ Y_{MM}(\theta_{s_i}, \varphi_{s_i}) + \sum_{r=0}^{N_r} H_r(f) Y_{MM}(\theta_{s,r}, \varphi_{s,r}) \end{pmatrix}$$

The use of a single ambisonic coefficient $Y'_{ij}$ representing both the sound wave and its reflections makes it possible to substantially decrease the calculating operations allowing the ambisonic coefficients to be obtained, in particular when the number of reflections is large. Specifically, this makes it possible to decrease the number of multiplications, since it is no longer necessary to multiply each of the intensities $S_i(f)$ of a source for each frequency by each of the spherical harmonics $Y_{ij}(\theta_{s,r},\varphi_{s,r})$, for each value of i such that $0 \le i \le M$, each value of j such that $-i \le j \le i$, and each reflection. This decrease in the number of multiplications allows a substantial decrease in the computational complexity, particularly in the case of a large number of reflections.

In one set of embodiments of the invention, the logic 430 for calculating spherical harmonics of the sound wave is configured to calculate the spherical harmonics of the sound wave and of the plurality of reflections on the basis of a fixed position of the source of the sound wave. In this case, the orientations $(\theta_{s_i},\varphi_{s_i})$ of the sound source and the orientations $(\theta_{s,r},\varphi_{s,r})$ of each of the harmonics are constant. The spherical harmonics of the sound wave and of the plurality of reflections then also have a constant value, and may be calculated once for the sound wave.

In other embodiments of the invention, the logic 430 for calculating spherical harmonics of the sound wave is configured to iteratively calculate the spherical harmonics of the sound wave and of the plurality of reflections on the basis of successive positions of the source of the sound wave. According to various embodiments of the invention, various possibilities exist for defining the calculating iterations. In one embodiment of the invention, the logic 430 is configured to recalculate the values of the spherical harmonics of the sound wave and of the plurality of reflections each time a change in the position of the source of the sound wave or in the position of the user is detected. In another embodiment of the invention, the logic 430 is configured to recalculate the values of the spherical harmonics of the sound wave and of the plurality of reflections at regular intervals, for example every 10 ms. In another embodiment of the invention, the logic 430 is configured to recalculate the values of the spherical harmonics of the sound wave and of the plurality of reflections in each of the time windows used by the logic 420 for transforming the frequency of the sound wave to convert the time samples of the sound wave into frequency samples.

In one set of embodiments of the invention, each reflection is characterized by a single acoustic coefficient $\alpha_r$.

In other embodiments of the invention, each reflection is characterized by an acoustic coefficient for each frequency of said frequency sampling. This makes it possible to obtain different acoustic coefficients for the various frequencies, and to improve the rendition of certain effects. For example, it is known that thick materials more readily absorb low frequencies. Similarly, some types of materials absorb and reflect high frequencies differently. Thus, defining different acoustic coefficients for one and the same reflection and different frequencies makes it possible to characterize the materials encountered by the reflections, allowing a better reproduction of various types of hall according to the materials of the walls thereof.

In one set of embodiments of the invention, a reflection at a frequency may be considered to be zero according to a comparison between the acoustic coefficient $\alpha_r$ for this frequency and a predefined threshold. For example, if the coefficient $\alpha_r$ represents a reverberation coefficient, the frequency is considered to be zero if it is below a predefined threshold. Conversely, if it is an attenuation coefficient, the frequency is considered to be zero if it is above or equal to a predefined threshold. This makes it possible to further limit the number of multiplications, and hence the complexity of the ambisonic encoding, while having a minimal impact on the binaural rendition.

In one set of embodiments of the invention, the ambisonic encoder 400 comprises a logic for calculating the acoustic coefficients and the delays, and the position of the virtual sound source of the reflections. This calculating logic may for example be configured to calculate the acoustic coefficients and the delays of the reflections according to estimates of a difference in the distance traveled by the sound between the position of the source of the sound wave and an estimated position both of a user and of the distance traveled by the sound between the positions of the virtual sound sources of the reflections and the estimated position of the user. It is in fact straightforward, having knowledge of the difference in the distance traveled by the sound wave to reach the user, in a straight line from the sound source and via reflection, and having knowledge of the speed of sound, to deduce the delay experienced by the user between the sound arising from the sound source in a straight line and the sound having been affected by reflection.

Similarly, it is known that the intensity of a sound wave decreases as it travels through the air. The logic for calculating the acoustic coefficients and the delays, and the position of the virtual sound source of the reflections, may therefore be configured to calculate an acoustic coefficient of a reflection of the sound wave according to the difference in the distance traveled between the sound arising from the sound source in a straight line and the sound having been affected by reflection.

In other embodiments of the invention, the logic for calculating the acoustic coefficients and the delays, and the position of the virtual sound source of the reflections, is also configured to calculate the acoustic coefficients of the reflections according to an acoustic coefficient of at least one obstacle to the propagation of sound waves, off which the sound is reflected. This makes it possible to better model the absorption by the materials of a hall, and the acoustic coefficient of the obstacle may vary with the various frequencies. The acoustic coefficient of the obstacle may be a reverberation coefficient or an attenuation coefficient.

Figure 5:
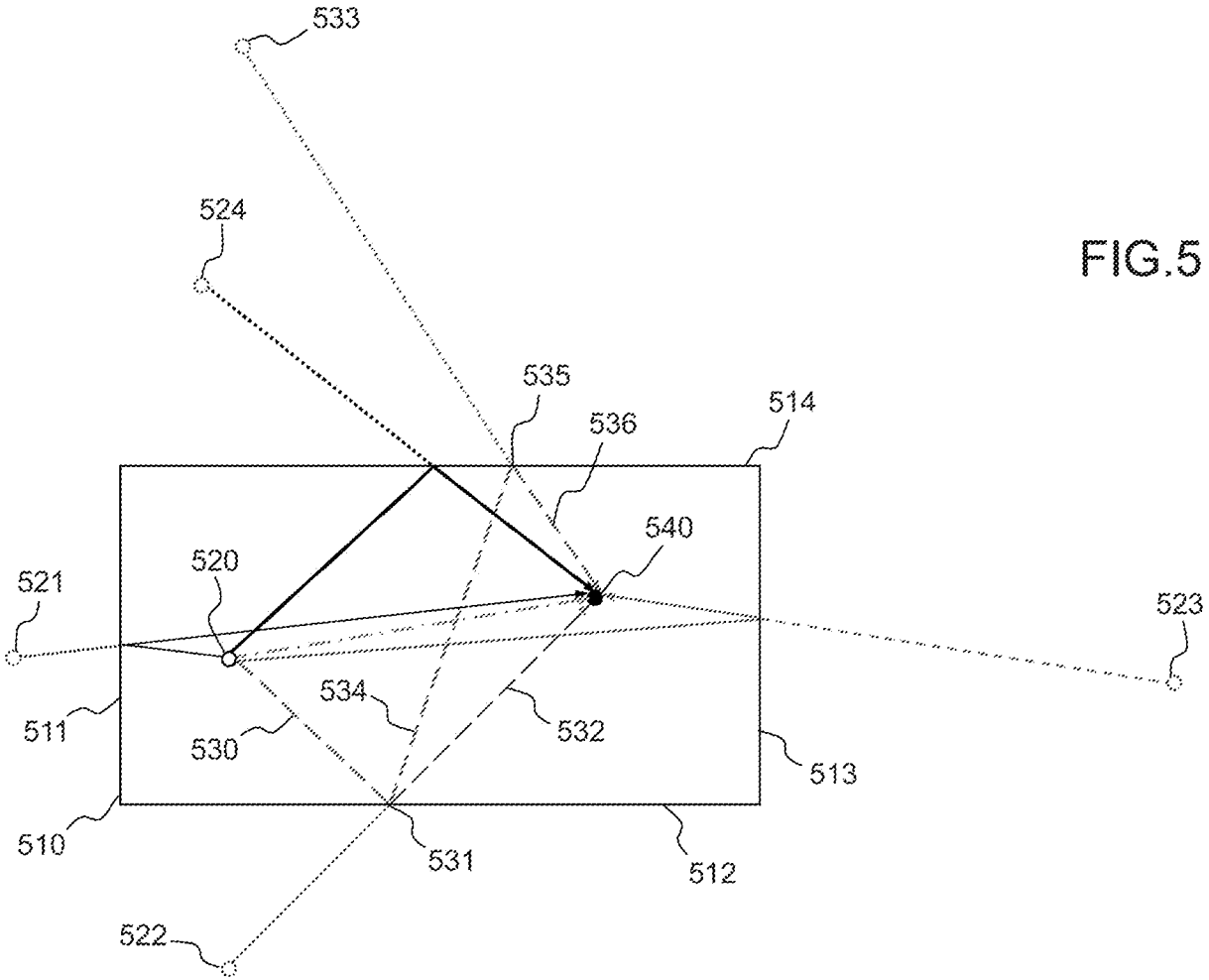
FIG. 5, one example of calculating a secondary sound source, in one mode of implementation of the invention.

FIG. 5 shows one example of calculating a secondary sound source, in one mode of implementation of the invention.

In this example, a source of the sound wave has a position 520 in a room 510, and the user has a position 540. The room 510 consists of four walls 511, 512, 513 and 514.

In one set of embodiments of the invention, the logic for calculating the acoustic coefficients and the delays, and the position of the virtual sound source of the reflections, is configured to calculate the position, the delay and attenuation of the virtual sound sources of the reflections in the following manner: for each of the walls 511, 512, 513 and 514, the logic is configured to calculate a position of a virtual sound source of a reflection as the inverse of the position of the sound source with respect to a wall. The calculating logic is thus configured to calculate the positions 521, 522, 523 and 524 of four virtual sound sources of the reflections with respect to the walls 511, 512, 513 and 514, respectively.

For each of these virtual sound sources, the calculating logic is configured to calculate a travel path of the sound wave and to deduce therefrom the corresponding acoustic coefficient and delay. In the case of the virtual sound source 511, for example, the sound wave follows the path 530 up to the point 531 of the wall 512, then the path 532 up to the position of the user 540. The distance traveled by the sound along the path 530, 532 makes it possible to calculate an acoustic coefficient and a delay of the reflection. In one set of embodiments of the invention, the calculating logic is also configured to apply an acoustic coefficient corresponding to the absorption of the wall 512 at the point 531. In one set of embodiments of the invention, this coefficient depends on the various frequencies, and may for example be determined, for each frequency, according to the material and/or the thickness of the wall 512.

In one set of embodiments of the invention, the virtual sound sources 521, 522, 523 and 524 are used to calculate secondary virtual sound sources, corresponding to multiple reflections. For example, a secondary virtual source 533 may be calculated as the inverse of the virtual source 521 with respect to the wall 514. The corresponding path of the sound wave then comprises the segments 530 up to the point 531; 534 between the points 531 and 535; 536 between the point 535 and the position 540 of the user. The acoustic coefficients and the delays may then be calculated on the basis of the distance traveled by the sound over the segments 531, 535 and 536, and the absorption of the walls at the points 531 and 535.

According to various embodiments of the invention, virtual sound sources corresponding to reflections may be calculated up to a predefined order n. Various embodiments are possible for determining the reflections to be retained. In one embodiment of the invention, the calculating logic is configured to calculate, for each virtual sound source, a higher order virtual sound source for each of the walls, up to a predefined order n. In one embodiment, the ambisonic encoder is configured to process a predefined number Nr of reflections per sound source, and retains the Nr reflections having the weakest attenuation. In another embodiment of the invention, the virtual sound sources are retained on the basis of a comparison of an acoustic coefficient with a predefined threshold.

Figure 6:
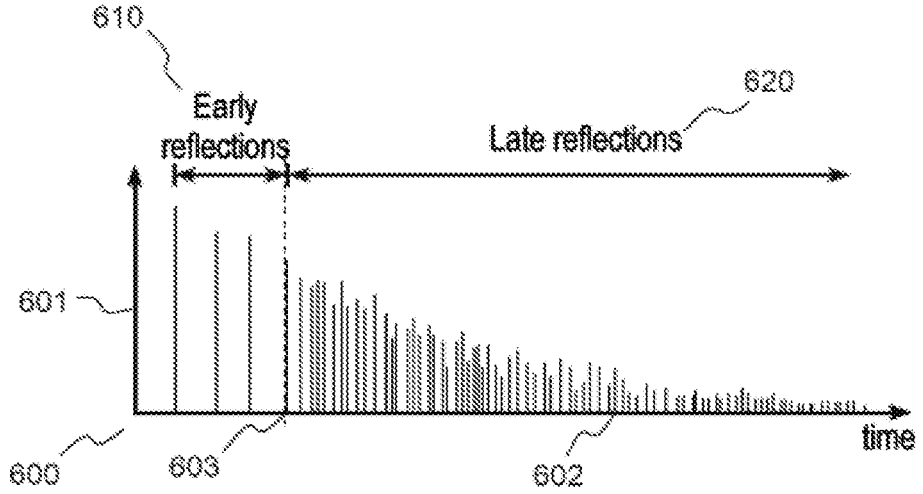
FIG. 6, one example of calculating early reflections and late reflections, in one embodiment of the invention.

FIG. 6 shows one example of calculating early reflections and late reflections, in one embodiment of the invention.

The diagram 600 shows the intensity of multiple reflections of the sound source with time. The axis 601 represents the intensity of a reflection and the axis 602 represents the delay between the emission of the sound wave by the source of the sound wave and the perception of a reflection by the user. In this example, the reflections occurring before a predefined delay 603 are considered to be early reflections 610 and the reflections occurring after the delay 603 are considered to be late reflections 620. In one embodiment of the invention, the early reflections are calculated using a virtual sound source, for example according to the principle described with reference to FIG. 5.

According to various embodiments of the invention, the late reflections are calculated in the following manner: a set of Nt secondary sound sources is calculated, for example according to the principle described in FIG. 5. The logic for calculating the acoustic coefficients and the delays, and the position of the virtual sound source of the reflections, is configured to retain a number Nr of reflections that is smaller than Nt, according to various embodiments described above. In one set of embodiments of the invention, the logic is additionally configured to compile a list of (Nt-Nr) late reflections, comprising all of the reflections that are not retained. This list comprises, for each late reflection, only an acoustic coefficient and a delay of the late reflection, and no position of a virtual source.

According to one embodiment of the invention, this list is transmitted by the ambisonic encoder to an ambisonic decoder. The ambisonic decoder is then configured to filter its outputs, for example its output stereo channels, with the acoustic coefficients and the delays of the late reflections, then to add these filtered signals to the output signals. This makes it possible to improve the sensation of immersion in a hall or a listening environment while further limiting the computational complexity of the encoder.

According to another embodiment of the invention, the ambisonic encoder is configured to filter the sound wave with the acoustic coefficients and the delays of the late reflections, and to add the obtained signals uniformly to all of the ambisonic coefficients. This makes it possible to obtain, with limited computational complexity, an effect that is representative of multiple reflections in a sound environment. In this embodiment of the invention, as in the preceding embodiment, the late reflections have a low intensity and do not have any information on the direction of a sound source. These reflections will therefore be perceived by a user as an "echo" of the sound wave, distributed uniformly throughout the sound scene, and representative of a listening environment.

Calculating the acoustic coefficients and delays of the late reflections results in the calculation of numerous reflections. It is therefore a relatively intensive operation in terms of computational complexity. According to one embodiment of the invention, this calculation is performed only once, for example upon initialization of the sound scene, and the acoustic coefficients and the delays of the late reflections are reused without modification by the ambisonic encoder. This makes it possible to obtain late reflections that are representative of the listening environment at lower cost. According to other embodiments of the invention, this calculation is performed iteratively. For example, these acoustic coefficients and delays of the late reflections may be calculated at predefined time intervals, for example every five seconds. This makes it possible to continually retain acoustic coefficients and delays of the late reflections that are representative of the sound scene, and relative positions of a source of the sound wave and of the user, while limiting the computational complexity linked to determining the late reflections.

In other embodiments of the invention, the acoustic coefficients and delays of the late reflections are calculated when the position of a source of the sound wave or of the user varies significantly, for example when the difference between the position of the user and a previous position of the user during a calculation of the acoustic coefficients and delays of the late reflections that are representative of the sound scene is above a predefined threshold. This makes it possible to calculate the acoustic coefficients and delays of the late reflections that are representative of the sound scene only when the position of a source of the sound wave or of the user has varied enough to perceptibly modify the late reflections.

Figure 7:
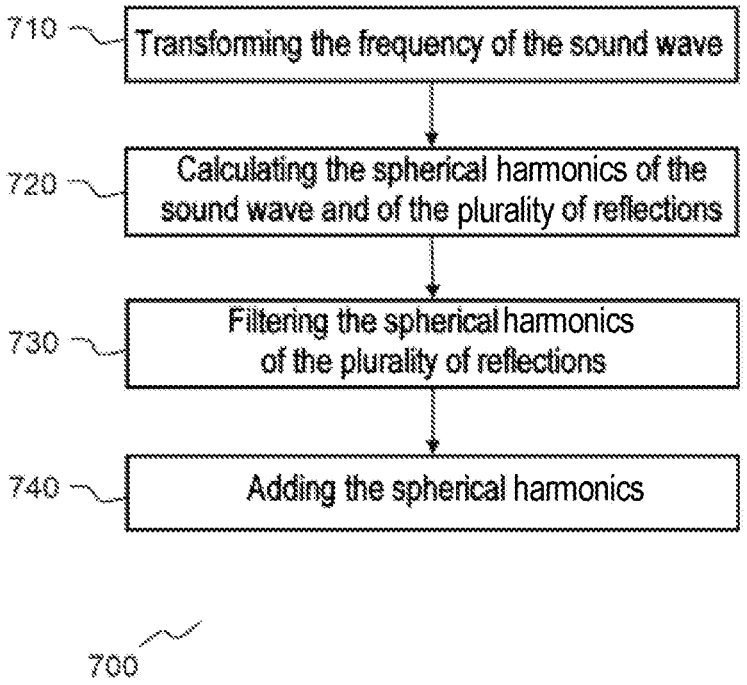
FIG. 7, a method for encoding a sound wave having a plurality of reflections, in one set of modes of implementation of the invention.

FIG. 7 shows a method for encoding a sound wave having a plurality of reflections, in one set of modes of implementation of the invention.

The method 700 comprises a step 710 of transforming the frequency of the sound wave.

The method then comprises a step 720 of calculating spherical harmonics of the sound wave and of the plurality of reflections on the basis of a position of a source of the sound wave and positions of obstacles to the propagation of sound waves.

The method then comprises a step 730 of filtering, by a plurality of filtering logics in the frequency domain, spherical harmonics of the plurality of reflections, each filtering logic being parameterized by acoustic coefficients and delays of the reflections.

The method then comprises a step 740 of adding spherical harmonics of the sound wave and outputs from the filtering logics.

The above examples demonstrate the capability of an ambisonic encoder according to the invention to calculate ambisonic coefficients of a sound wave having a plurality of reflections. These examples are however given only by way of example and in no way limit the scope of the invention, which is defined in the claims below.

The invention claimed is:

1. An ambisonic encoder for a sound wave having a plurality of reflections, comprising:

a logic for calculating spherical harmonics of the sound wave and of the plurality of reflections on a basis of a position of a source of the sound wave and positions of obstacles to propagation of the sound wave, wherein:

the reflections are represented by at least one virtual source of reflection, where an orientation of the least one virtual source of reflection is calculated based on the position of the source of the sound wave and the position of the obstacles to propagation of the sound wave; and the spherical harmonics of the plurality of reflections are calculated based on the calculated orientation of the virtual source of reflection;

a filtering logic receiving, as input, the calculated spherical harmonics of the plurality of reflections, the filtering logic parameterized by acoustic coefficients and delays of the plurality of reflections; and a logic for adding spherical harmonics of the sound wave and outputs from the filtering logic.

2. The ambisonic encoder as claimed in claim 1, wherein the logic for calculating spherical harmonics of the sound wave is configured to calculate the spherical harmonics of the sound wave and of the plurality of reflections on the basis of a fixed position of the source of the sound wave.

3. The ambisonic encoder as claimed in claim 1, wherein the logic for calculating spherical harmonics of the sound wave is configured to iteratively calculate the spherical harmonics of the sound wave and of the plurality of reflections on the basis of successive positions of the source of the sound wave.

4. The ambisonic encoder as claimed in claim 1, wherein each reflection is characterized by a unique acoustic coefficient.

5. The ambisonic encoder as claimed in claim 1, wherein each reflection is characterized by an acoustic coefficient for each frequency of the frequency sampling.

6. The ambisonic encoder as claimed in claim 1, further comprising logic for calculating the acoustic coefficients, the delays and the position of the virtual sound sources of the reflections, the calculating logic being configured to calculate the acoustic coefficients and the delays of the reflections according to estimates of a difference in the distance traveled by the sound between the position of the source of the sound wave and an estimated position both of a user and of a distance traveled by the sound between the positions of the virtual sound sources of the reflections and the estimated position of the user.

7. The ambisonic encoder as claimed in claim 6, wherein the logic for calculating the acoustic coefficients, the delays and the positions of the virtual sound sources of the reflections is further configured to calculate the acoustic coefficients of the reflections according to at least one acoustic coefficient of at least one obstacle to the propagation of sound waves, off which the sound is reflected.

8. The ambisonic encoder as claimed in claim 6, wherein the logic for calculating the acoustic coefficients, the delays and the positions of the virtual sound sources of the reflections is configured to calculate positions of virtual sound sources of the reflections as inverses of the position of the source of the sound wave with respect to a plane that is tangential to an obstacle to the propagation of sound waves.

9. The ambisonic encoder as claimed in claim 6, wherein the logic for calculating the acoustic coefficients, the delays and the positions of the virtual sound sources of the reflections is configured to calculate acoustic coefficients and delays of a plurality of late reflections.

10. The ambisonic encoder as claimed in claim 1, wherein the logic for calculating spherical harmonics of the sound wave and of the plurality of reflections is further configured to calculate spherical harmonics of the sound wave and of the plurality of reflections at each output frequency of the frequency transformation circuit, the ambisonic encoder further comprising logic for calculating binaural coefficients of the sound wave, which logic is configured to calculate binaural coefficients of the sound wave by multiplying, at each output frequency of the circuit for transforming the frequency of the sound wave, the signal of the sound wave by the spherical harmonics of the sound wave and of the plurality of reflections at this frequency.

11. A method for ambisonically encoding a sound wave having a plurality of reflections, comprising:

calculating spherical harmonics of the sound wave and of the plurality of reflections on a basis of a position of a source of the sound wave and positions of obstacles to propagation of sound waves, wherein:

the reflections are represented by at least one virtual source of reflection, where an orientation of the least one virtual source of reflection is calculated based on the position of the source of the sound wave and the position of the obstacles to propagation of the sound wave; and the spherical harmonics of the plurality of reflections are calculated based on the calculated orientation of the virtual source of reflection;

filtering the calculated spherical harmonics of the plurality of reflections, wherein the filtering is parameterized by one or more of acoustic coefficients and delays of the plurality of reflections; and adding spherical harmonics of the sound wave and outputs from the filtering.

12. A non-transitory computer-readable medium, storing instructions which when executed by a processor, causes the processor to:

calculate spherical harmonics of the sound wave and of a plurality of reflections on a basis of a position of a source of the sound wave and positions of obstacles to propagation of the sound wave, wherein:

the reflections are represented by at least one virtual source of reflection, where an orientation of the least one virtual source of reflection is calculated based on the position of the source of the sound wave and the position of the obstacles to propagation of the sound wave; and the spherical harmonics of the plurality of reflections are calculated based on the calculated orientation of the virtual source of reflection;

parameterize a filtering logic receiving, as input, spherical harmonics of the plurality of reflections, wherein the filtering logic is parameterized by one or more of acoustic coefficients and delays of the reflections; and add spherical harmonics of the sound wave and outputs from the filtering logic.

* * * * *